US006844508B2

(12) United States Patent
Lim

(10) Patent No.: US 6,844,508 B2
(45) Date of Patent: Jan. 18, 2005

(54) KEY PATTERN CONNECTING DEVICE FOR DOMED METAL SWITCH

(75) Inventor: Heui-Do Lim, Suwon-shi (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 10/759,571

(22) Filed: Jan. 16, 2004

(65) Prior Publication Data

US 2004/0144636 A1 Jul. 29, 2004

(30) Foreign Application Priority Data

Jan. 27, 2003 (KR) ..... 10-2003-0005204

(51) Int. Cl.[7] ..... H01H 13/70
(52) U.S. Cl. ..... 200/5 A; 200/516; 200/406
(58) Field of Search ..... 200/5 A, 512, 200/516, 517, 406; 345/168, 169; 341/22; 400/472

(56) References Cited

U.S. PATENT DOCUMENTS 5,877,709 A * 3/1999 Ala-Lehtimaki et al. ..... 341/26
5,900,829 A * 5/1999 Gardner et al. ..... 341/26
5,986,228 A * 11/1999 Okamoto et al. ..... 200/516
6,259,046 B1 * 7/2001 Iwama et al. ..... 200/5 A
6,333,477 B1 * 12/2001 Koyama et al. ..... 200/513
6,417,467 B1 * 7/2002 Yamagata ..... 200/5 A
6,444,928 B2 * 9/2002 Okamoto et al. ..... 200/5 A
6,639,159 B2 * 10/2003 Anzai ..... 200/1 B
6,768,074 B2 * 7/2004 Iwama ..... 200/515

* cited by examiner

*Primary Examiner*—Michael A. Friedhofer
(74) *Attorney, Agent, or Firm*—Dilworth & Barrese, LLP

(57) ABSTRACT

A key pattern connecting device for a domed metal switch. The domed metal switch includes first and second contact parts arranged in a key matrix on a main board. The key pattern connecting device comprises at least one first contact part electrically connected to columns by means of main connection patterns on the main board, at least one second contact part electrically connected to rows by means of the main connection patterns, a plurality of domed metal keys provided to the surfaces of the contact parts, respectively, and a flexible circuit attached to the main board in such a manner that the keys are projected through the flexible circuit. The flexible circuit has a plurality of connection patterns formed in such a manner that the connection patterns come into contact with the keys connected to the columns and the keys connected to the rows, respectively.

10 Claims, 14 Drawing Sheets

KEY PATTERN CONNECTING DEVICE FOR DOMED METAL SWITCH

PRIORITY

This application claims priority to an application entitled "KEY PATTERN CONNECTING DEVICE FOR DOMED METAL SWITCH", filed in the Korean Industrial Property Office on Jan. 27, 2003 and assigned Serial No. 2003-5204, the contents of which are hereby incorporated by reference.

BACKGROUND OF THE INVENTION

1. Field of the Invention

The present invention relates to a key pattern connecting device for a domed metal switch, and more particularly to a key pattern connecting device for a domed metal switch having connection patterns provided to a main board and a flexible circuit, respectively, in such a manner that the main board and the flexible circuit are electrically connected to each other without an auxiliary key connecting part on the domed metal switch.

2. Description of the Related Art

Generally, "a mobile communication device" means a device that is portable and enables an owner of the device to communicate in a wireless way. Such a mobile communication device includes, for example, a bar-type wireless communication terminal comprising a single housing; a flip-type wireless communication terminal comprising a bar-type housing and a flip part pivotably attached to the housing; and a folder-type wireless communication terminal comprising a bar-type housing and a folder part pivotably attached to the housing. The aforesaid conventional mobile communication devices essentially include an antenna, data input/output units, and data transmitting/receiving units. Usually, the data input unit is a keypad that is pressed down to input data. Alternatively, a touch pad or a touch screen may be used. The keypad, which is used to input data, basically comprises an array of several keys. The keys include, for example, a send key (SND), which is a communication start key, a cancel key, a clear key (CLR), numeric keys, letter keys, an end key (END), functional keys, and a power on/off key (PWR).

The aforesaid keys are usually arranged on the surface of the housing of the mobile communication device up to the number of about 15 to 20. Of course, the keys are exposed on the surface of the housing to enable a user to input desired data by pressing down on the keys using his/her finger. The keys of the mobile communication device may comprise a domed metal switch, which enables the user to actually feel that he or she is operating the communication device.

As illustrated in FIG. 1, the domed metal switch includes a main body 1, on which a main board 2 is provided with a plurality of first and second contact parts 2*a* and 2*b* arranged in a key matrix. Domed metal keys 3 are arranged on the first and the second contact parts 2*a* and 2*b*.

As illustrated in FIG. 2, around the domed metal keys 3 is provided a first adhesive 4, which fixes the key to the main board 2. On the first adhesive 4 is attached a light diffusion film 5, which is also provided around the domed metal keys 3. On the surfaces of the light diffusion film 5 and the domed metal key 3 are applied a second adhesive 6, to which a transparent film 7 is attached. The domed metal keys 3 include a plurality of main keys 3*a* and auxiliary keys 3*b*, such a volume key, as illustrated in FIG. 4.

As illustrated in FIGS. 3 and 4, the main keys 3*a* and auxiliary keys 3*b*, being 16 in number, are arranged in a key matrix of 4×4. On the main board 2 are provided a plurality of main connection patterns 9 in such a manner that the first contact parts 2*a* are electrically connected to Row0, Row1, Row2, and Row3, respectively. Similarly, on the main board 2 are provided a plurality of main connection patterns 9 in such a manner that the second contact parts 2*b* are electrically connected to Col0, Col1, Col2, and Col3, respectively. The Rows and Cols together form a key input controller 20. The auxiliary keys 3*b*, which are provided at one side of the main board 2, are electrically connected to the main board 2 by means of an auxiliary key connecting part 8 provided separately on the main board 2. The auxiliary key connecting part 8 may be formed of a flexible connector or a solder connector. The auxiliary keys 3*b* include a flexible circuit 10, on which first and second contact parts 11 and 12 are provided.

Connection patterns 13 are further provided on the flexible circuit 10 in such a manner that the first contact parts 11 are electrically connected to Row2 and Row3, respectively, and the second contact parts 12 are electrically connected to Col3, while the first and second contact parts 11 and 12 of the auxiliary keys 3*b* are connected to the auxiliary key connecting part 8. The domed metal keys 3 are provided on the first and second contact parts 11 and 12 connected as mentioned above. At this time, prior to a user pressing on the keys, the domed metal keys 3 come into contact with the first contact parts 2*a*, not the second contact parts 2*b* provided in the first contact parts 2*a*.

The operation of the domed metal keys 3 arranged in a key matrix will now be described with reference to FIG. 5. Prior to the keys being pressed down in the key matrix (initial condition), all bits in an internal 10-bit register are '0.' That is, the resulting value output from the key matrix is '00000 00000.' At this time, when a user presses down the key at Row0 and Col0 on the key matrix, i.e., key[0][0], there occurs a key interrupt, and the resulting value of the interrupt displayed on the internal 10-bit register of the controller of the mobile communication device will be '00001 00001.' Then, in order to confirm that the key at Row0 and Col0, i.e., key[0][0], has been pressed down, the key input controller divides the internal 10-bit register into upper 5 bits and lower 5 bits, and checks which of the bits is '1,' respectively. As a result, it is confirmed that the pressed key is key[0][0], which is in turn compared to the previous pressed key. Since no key is previously pressed down, it is recognized that the present pressed key is key[0][0]. Under this condition, if the user presses down key[1][1], the resulting value of the key interrupt displayed on the internal 10-bit register by the key interrupt from the key matrix will be '00011 00011.' At this time, the internal 10-bit register is divided into upper 5 bits and lower 5 bits, and it is checked which of the bits is '1,' respectively. Expected keys from the key input controller are key[0][0], key[0][1], key[1][0], key[1][1] . . . Since key[0][0] was previously pressed down and key[1][1] is presently pressed down, the key input controller determines logically the state of the previous and present keys to determine that the present pressed key is key[1][1] among key[0][0], key[0][1], key[1][0], key[1][1] . . .

Since the aforesaid conventional domed metal switch further includes the auxiliary key connecting part for connecting the auxiliary keys to the main board, however, there is further needed space for the auxiliary key connecting part on the main board, which makes it difficult to reduce the size and weight of the mobile communication device. Furthermore, since the auxiliary key connecting part of the conventional domed metal switch is made of a flexible connector or a solder connector, there is further needed a step for soldering the connector to the main board, which may increase the potential for defective products. As a result, reliability of the products becomes reduced, a process for assembling the products is complicated, and the costs for manufacturing the products are increased. In addition, static electricity is applied frequently to the domed metal switch via the key parts of the switch. However, as the size of the mobile communication device is reduced, a part for discharging the static electricity becomes weaker. Consequently, the main board may not be stable because of the static electricity. In cases where static electricity is applied to the main board via the keys of the domed metal switch, the static electricity may not be discharged stably, and the shielding effect from the static electricity may be reduced.

SUMMARY OF THE INVENTION

Therefore, it is an object of the present invention to provide a key pattern connecting device for a domed metal switch having connecting patterns provided to a main board and a flexible circuit, respectively, in such a manner that the main board and the flexible circuit are electrically connected to each other without an auxiliary key connecting part on the domed metal switch, whereby performance of the domed metal switch is improved.

It is a further object of the present invention to provide a key pattern connecting device for a domed metal switch having connecting patterns provided to a main board and a flexible circuit, respectively, in such a manner that the main board and the flexible circuit are electrically connected to each other without an auxiliary key connecting part on the domed metal switch, whereby the size and weight of the end products are reduced.

It is another object of the present invention to provide a key pattern connecting device for a domed metal switch having connecting patterns provided to a main board and a flexible circuit, respectively, in such a manner that the main board and the flexible circuit are electrically connected to each other without an auxiliary key connecting part on the domed metal switch, whereby static electricity is guided to an electrostatically stable part in the event that static electricity is applied to the main board and the flexible circuit via keys.

It is another object of the present invention to provide a key pattern connecting device for a domed metal switch having connecting patterns provided to a flexible circuit in such a manner that the main board is electrically connected to the domed metal switch without an auxiliary key connecting part on the domed metal switch, whereby the shielding effect of static electricity is improved.

It is yet another object of the present invention to provide a key pattern connecting device for a domed metal switch having contact terminals provided to a flexible circuit for facilitating contact of the flexible circuit and domed metal keys, whereby contact between the domed metal keys and the flexible circuit is improved.

In accordance with the present invention, the above and other objects can be accomplished by the provision of a key pattern connecting device for a domed metal switch, said domed metal switch including a plurality of first and second contact parts arranged in a key matrix on a main board, said first contact parts being electrically connected to rows provided to a key input controller by means of a plurality of main connection patterns, respectively, said second contact parts, which are disposed within said first contact parts, respectively, being electrically connected to columns provided to said key input controller by means of another plurality of main connection patterns, respectively, said key pattern connecting device comprising: at least one first contact part electrically connected to one of said columns, not rows, by means of said main connection patterns on said main board; at least one second contact part electrically connected to one of said rows, not columns, by means of said main connection patterns on said main board; a plurality of domed metal keys provided to the surfaces of said contact parts, respectively; and a flexible circuit attached to said main board in such a manner that said domed metal keys are projected through said flexible circuit, said flexible circuit having a plurality of connection patterns formed in such a manner that the connection patterns come into contact with said domed metal keys connected to said columns and said domed metal keys connected to said rows, respectively.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
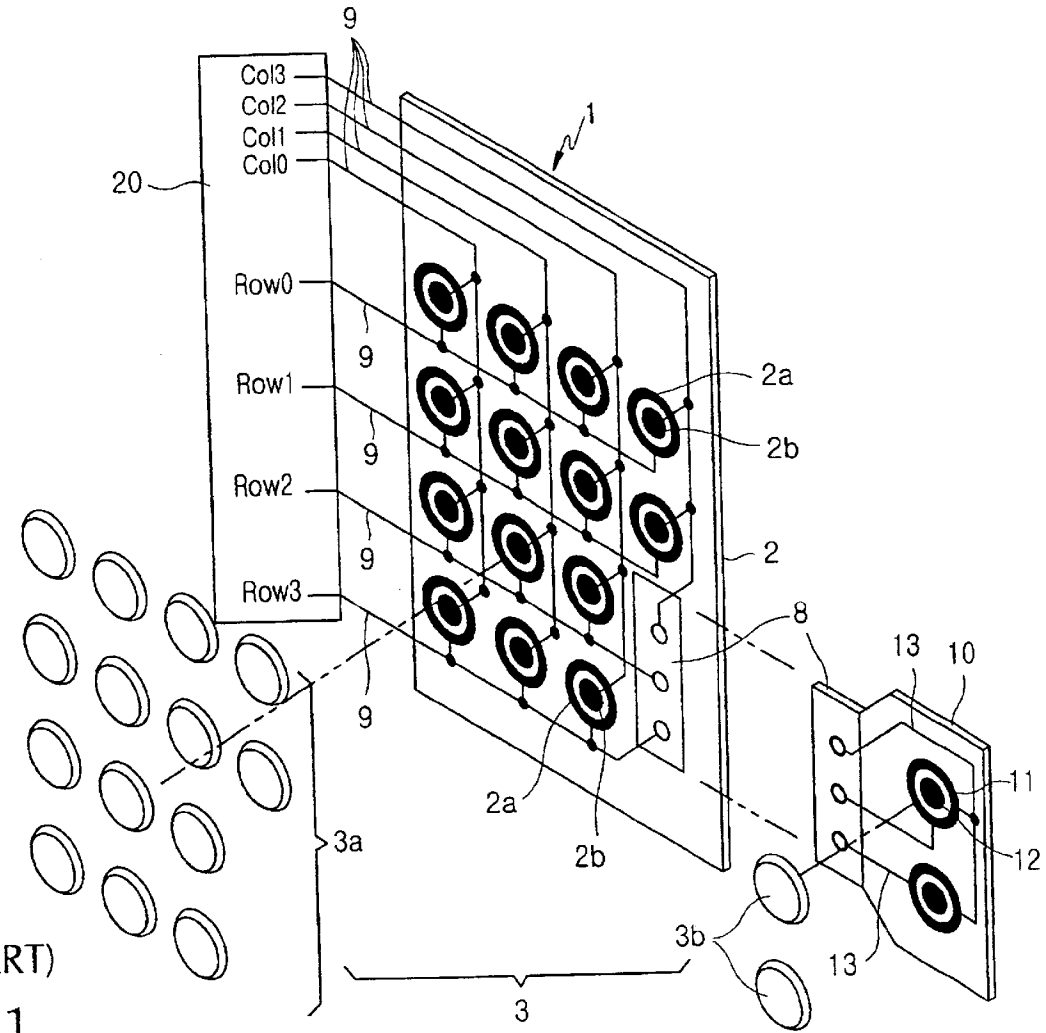
(PRIOR ART) FIG.1
FIG. 1 is an exploded perspective view showing the structure of a domed metal switch of the prior art.
Figure 2:
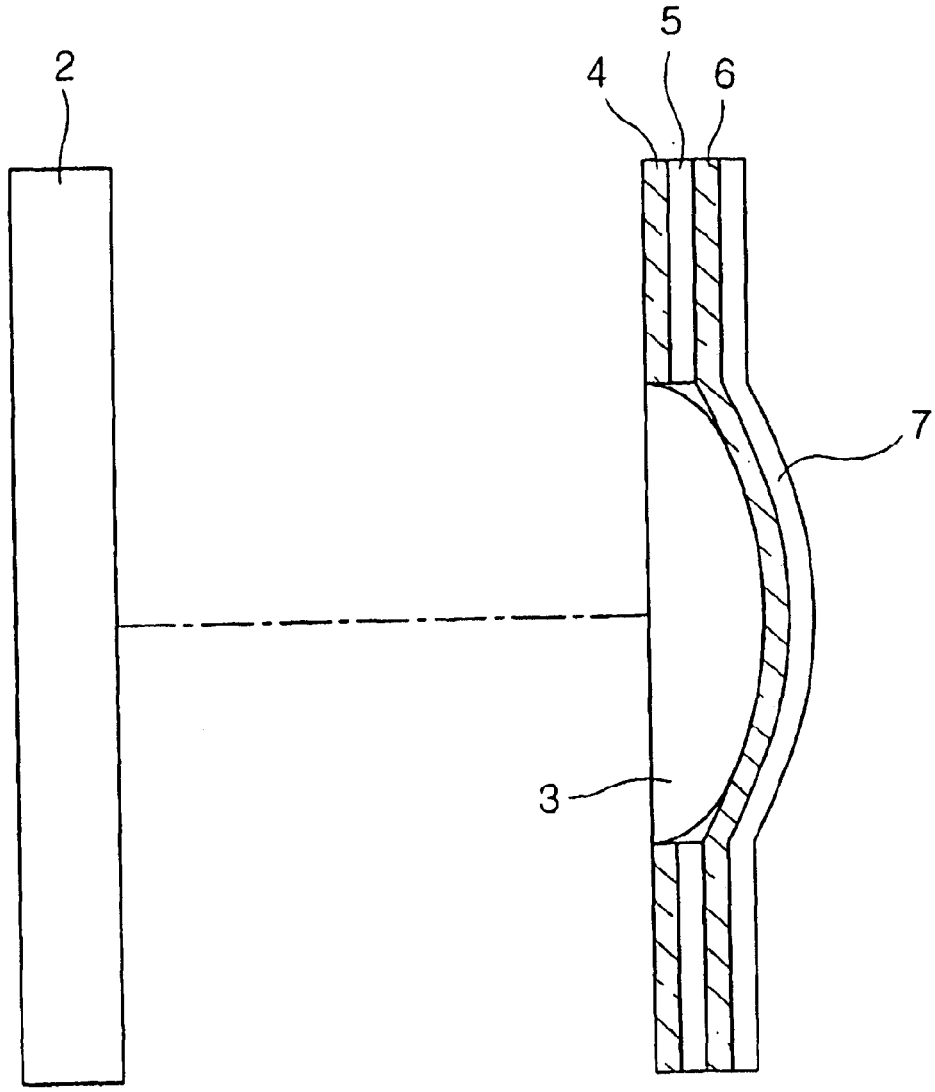
FIG.2 (PRIOR ART)
FIG. 2 is a cross sectional view showing a domed metal key and a domed metal key contact part of the prior art.
Figure 3:
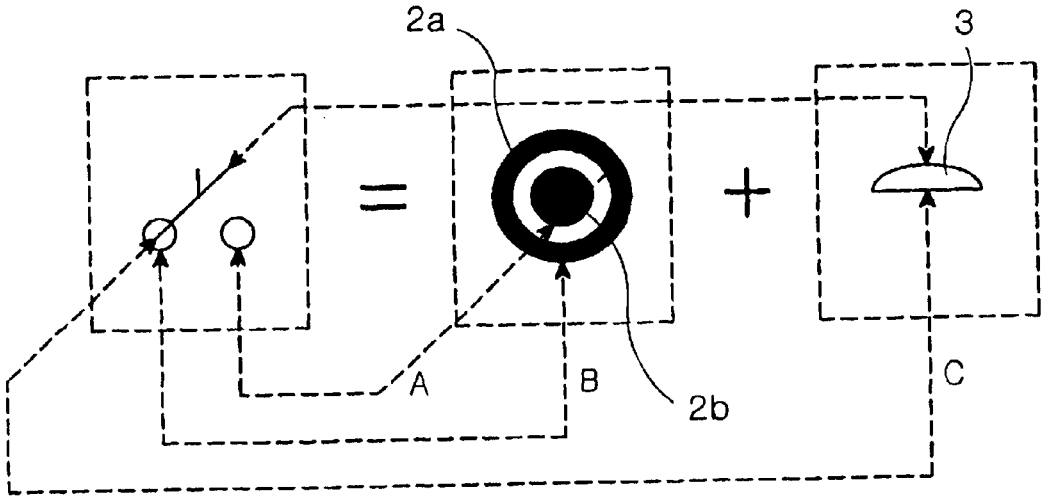
FIG.3 (PRIOR ART)
FIG. 3 shows symbols indicated in a circuit diagram of a domed metal key of the prior art.
Figure 4:
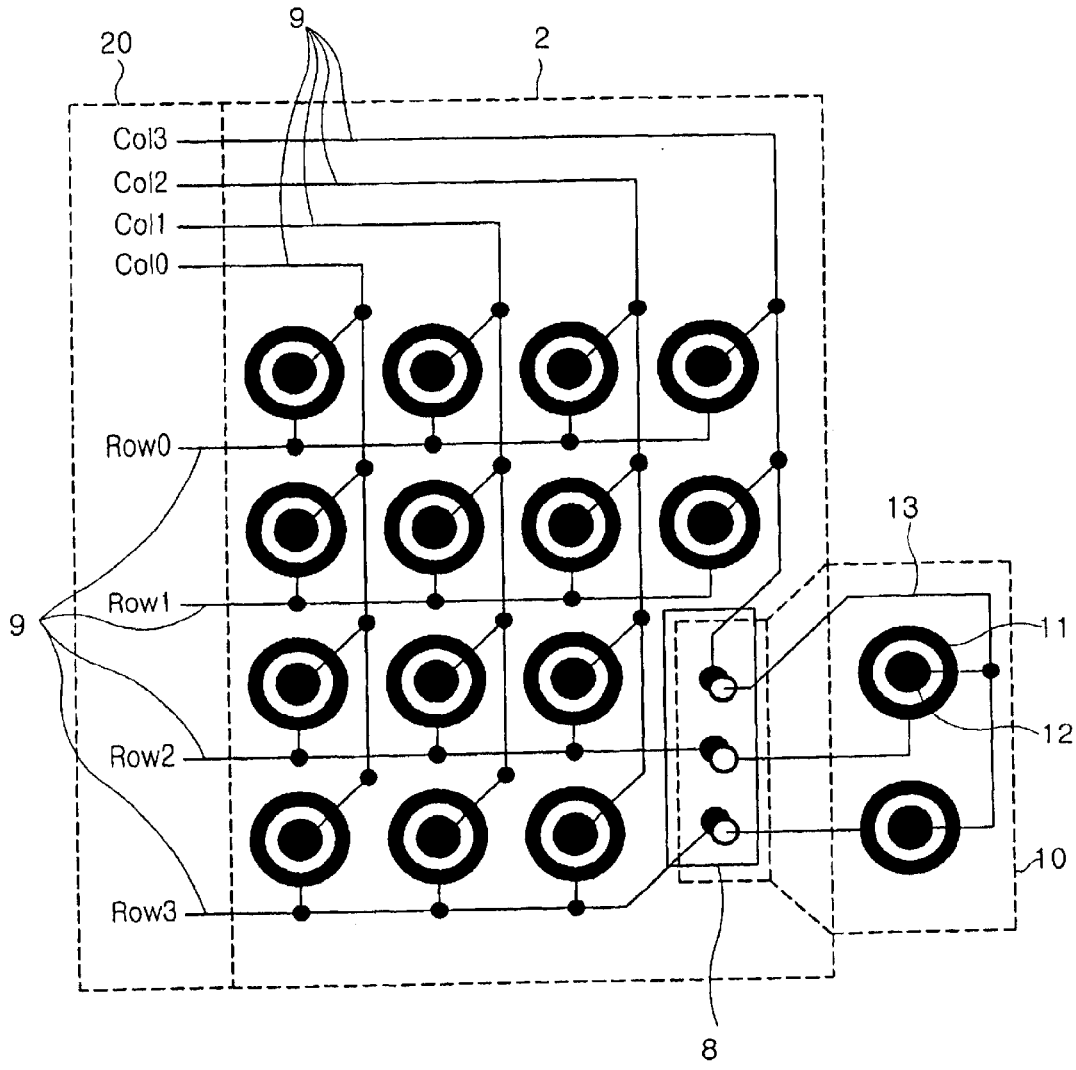
FIG.4 (PRIOR ART)
FIG. 4 is a pattern connection diagram of a domed metal key contact part of the prior art.
Figure 5:
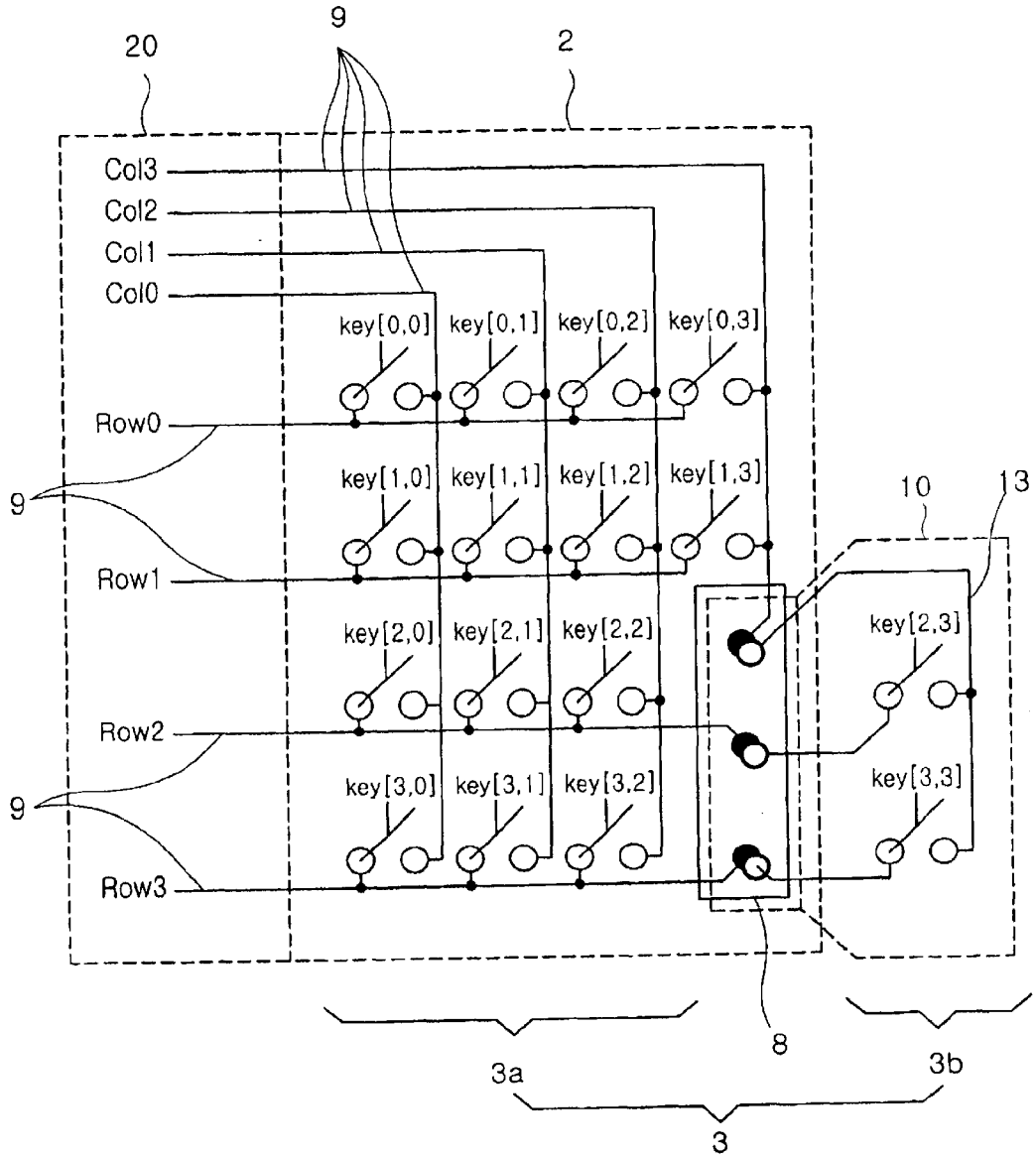
FIG.5 (PRIOR ART)
FIG. 5 is a circuit diagram of a domed metal key of the prior art.

Now, preferred embodiments of the present invention will be described in detail with reference to the annexed drawings. In the drawings, the same or similar elements are denoted by the same reference numerals even though they are depicted in different drawings.

As illustrated in FIGS. 6 to 14, a key pattern connecting device for a domed metal switch comprises a main board 2, domed metal keys 3 and 300, and a flexible circuit 400. On the main board 2 are provided a plurality of first and second contact parts 2*a* and 2*b*, which are arranged in a key matrix. The first contact part 2*a* are electrically connected to Rows, for example, Row0, Row1, Row2, and Row3, provided to a key input controller 20 by means of main connection patterns 9, while the second contact parts 2*b*, which are disposed within the first contact parts 2*a*, respectively, are electrically connected to columns, for example, Col0, Col1, Col2, and Col3, also provided to the key input controller 20 by means of the main connection patterns 9. On the main board 2 is provided at least one first contact part 100, which is electrically connected to one of the columns, not rows, by means of main connection patterns 101, unlike the first contact parts 2*a* which are connected to the rows. On the main board 2 is further provided at least one second contact part 200, which is electrically connected to one of the rows, not columns, by means of main connection patterns 201, unlike the second contact parts 2*b* which are connected to the columns. The domed metal keys 3 and 300 are provided on the surfaces of the contact parts, respectively, in such a manner that they are in electrical contact with the first contact parts 2*a* and 100, respectively, prior to being pressed. The flexible circuit 400 is attached to the main board 2 in such a manner that the domed metal keys 3 and 300 project through the flexible circuit. On the flexible circuit 400 is provided a plurality of connection patterns 401 for connecting electrically the domed metal keys 300 electrically connected to Col3 with the domed metal keys 3 electrically connected to Row2 and Row3.

As illustrated in the drawings, the first contact parts 100 connected to Col3 of the main board 2 and the second contact parts 200 connected to Row0 and Row1 are arranged at one side of the key matrix. The main connection patterns 9 include first main connection patterns 101 electrically connected to the first contact parts 100. Also, the main connection patterns 9 include second main connection patterns 201 electrically connected to the second contact parts 200. In the flexible circuit 400 are formed a plurality of through holes 402, through which the domed metal keys 3 and 300 project. The through holes 402 have annular contact rings 403 formed along the circumferences of the through holes 402. The annular contact rings 403 each have a diameter smaller than that of each of the domed metal keys 3 and 300 so that the annular contact rings 403 cover the edges of the domed metal keys 3 and 300. In the through holes 402 is projected inwardly at least one contact terminal 404 (FIGS. 12–14) of a predetermined length in such a manner that the contact terminal 404 is in contact with the domed metal keys 3 and 300 at the circumferences thereof.

Figure 11:
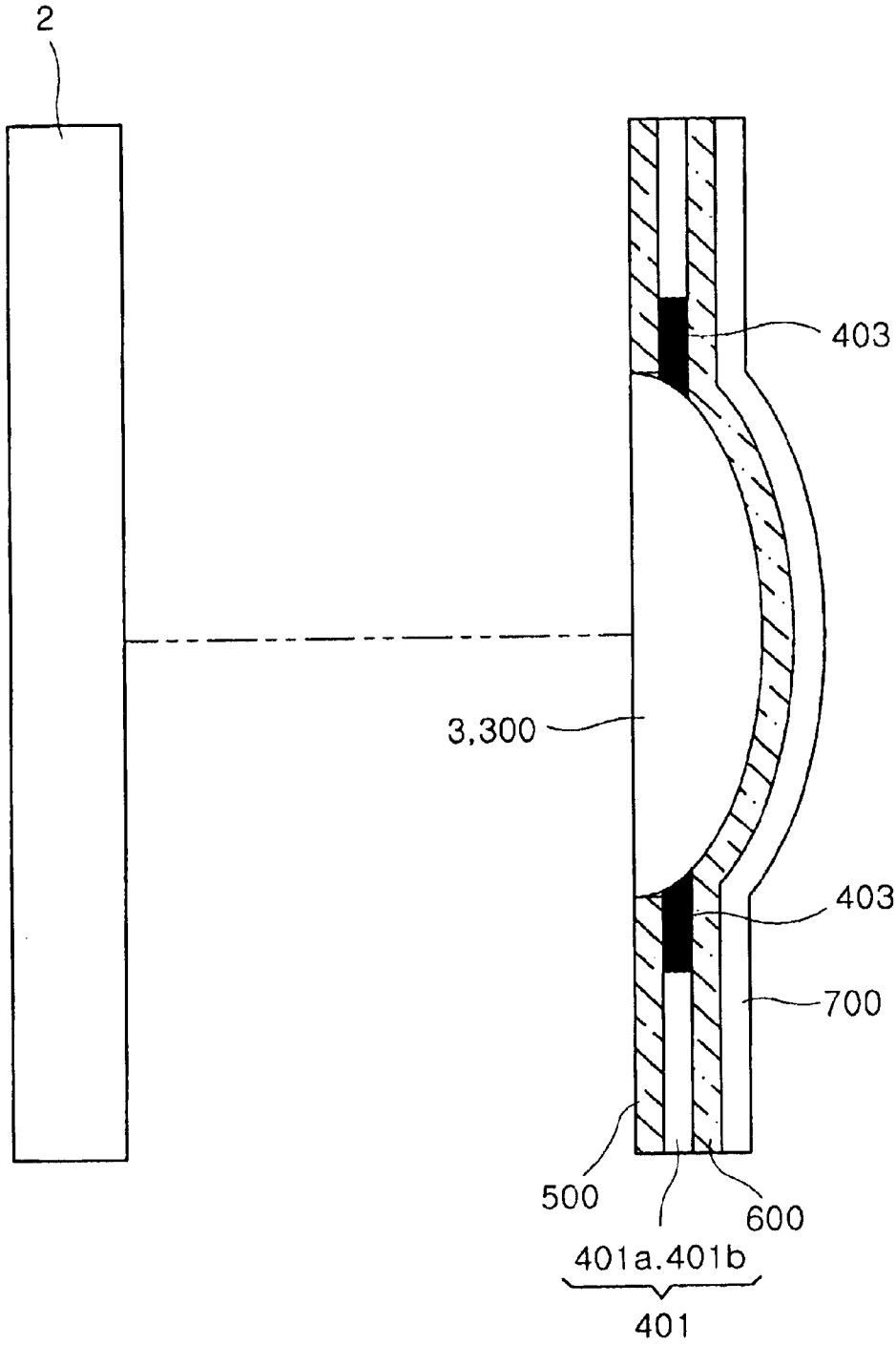
FIG. 11 is a cross sectional view of one of domed metal keys of a key pattern connecting device for a domed metal switch according to another embodiment of the present invention.

The connection patterns 401 include first connection patterns 401*a* connected to the domed metal keys 300, and second connection patterns 401*b* connected to the domed metal keys 3. The domed metal keys 3 and 300 include the domed metal keys 300 connected to the columns and the domed metal keys 3 connected to the rows. The connection patterns 401 are connected to the circumferences of the domed metal keys 3 and 300 at the upper part of the domed metal keys 3 and 300. On the flexible circuit 400 are provided first and second contact keys 11 and 12, which are connected to auxiliary keys 3*b*. Also, as seen in FIG. 11, the flexible circuit 400 is provided at the bottom part thereof with a first adhesive 500, which is applied to the surface of the main board 2. The flexible circuit 400 is provided at the top part thereof with a second adhesive 600, by which a transparent film 700 is attached to the flexible circuit 400.

The operation of the key pattern connecting device for the domed metal switch according to the preferred embodiments of the present invention will now be described in detail with reference to FIGS. 6 to 14.

Figure 6:
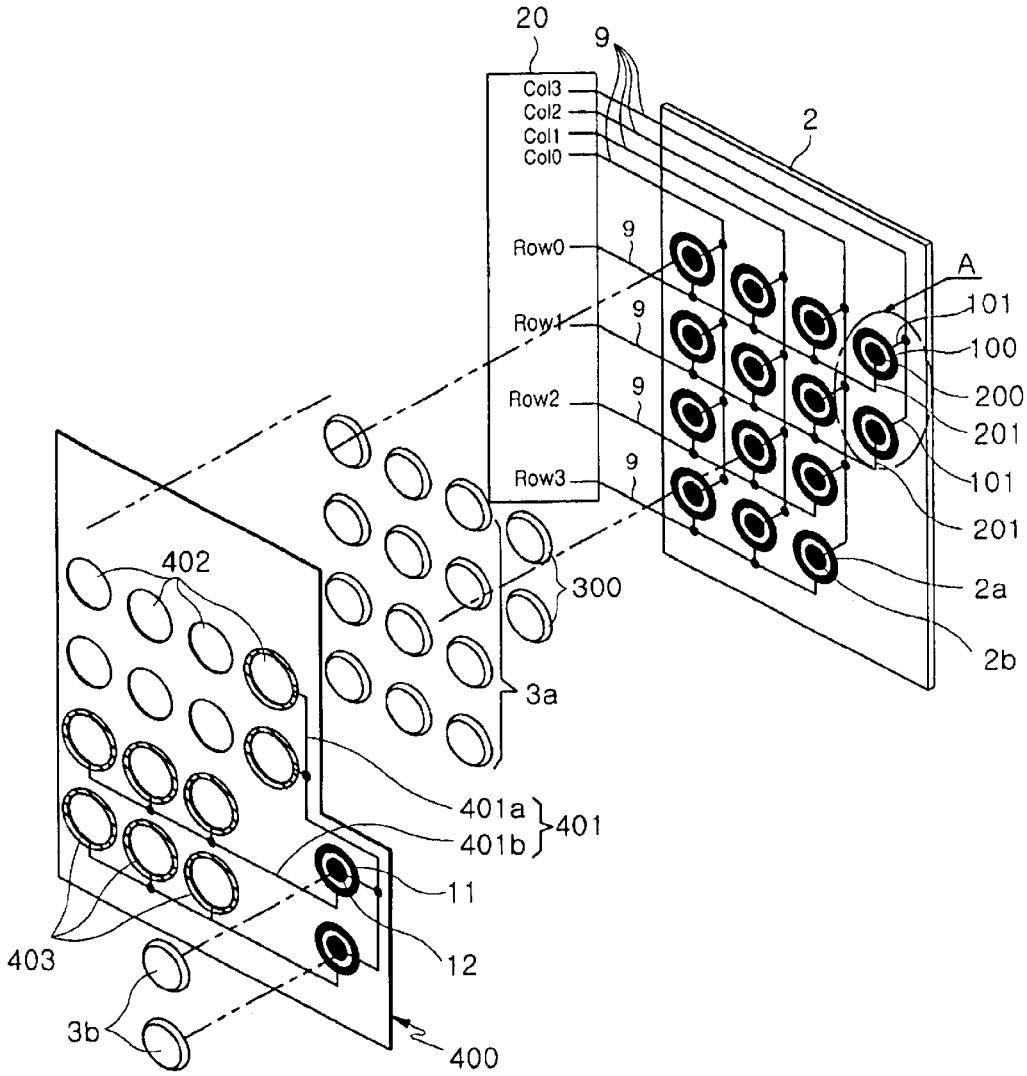
FIG. 6 is an exploded perspective view showing the structure of a key pattern connecting device for a domed metal switch according to an embodiment of the present invention.
Figure 7:
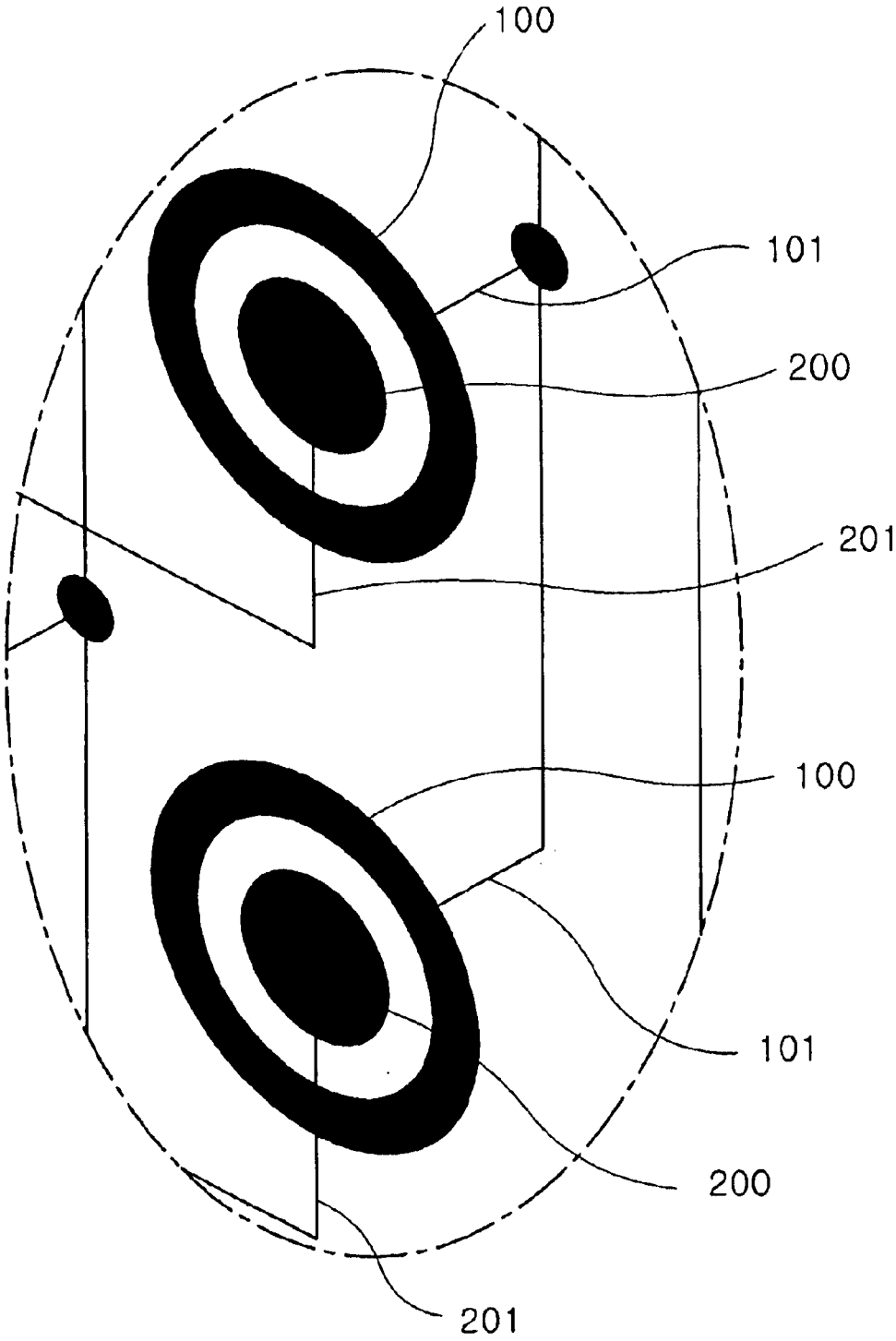
FIG. 7 is an enlarged perspective view of "A" part of FIG. 6.

As illustrated in FIGS. 6 and 7, the keys, being 16 in number, in the domed metal switch are arranged in a key matrix, for example, of 4×4. On the main board 2 are provided the first and second contact parts 2*a* and 2*b*; 100 and 200, which are electrically connected to 14 of the keys, except for the two auxiliary keys 3*b*.

Figure 8:
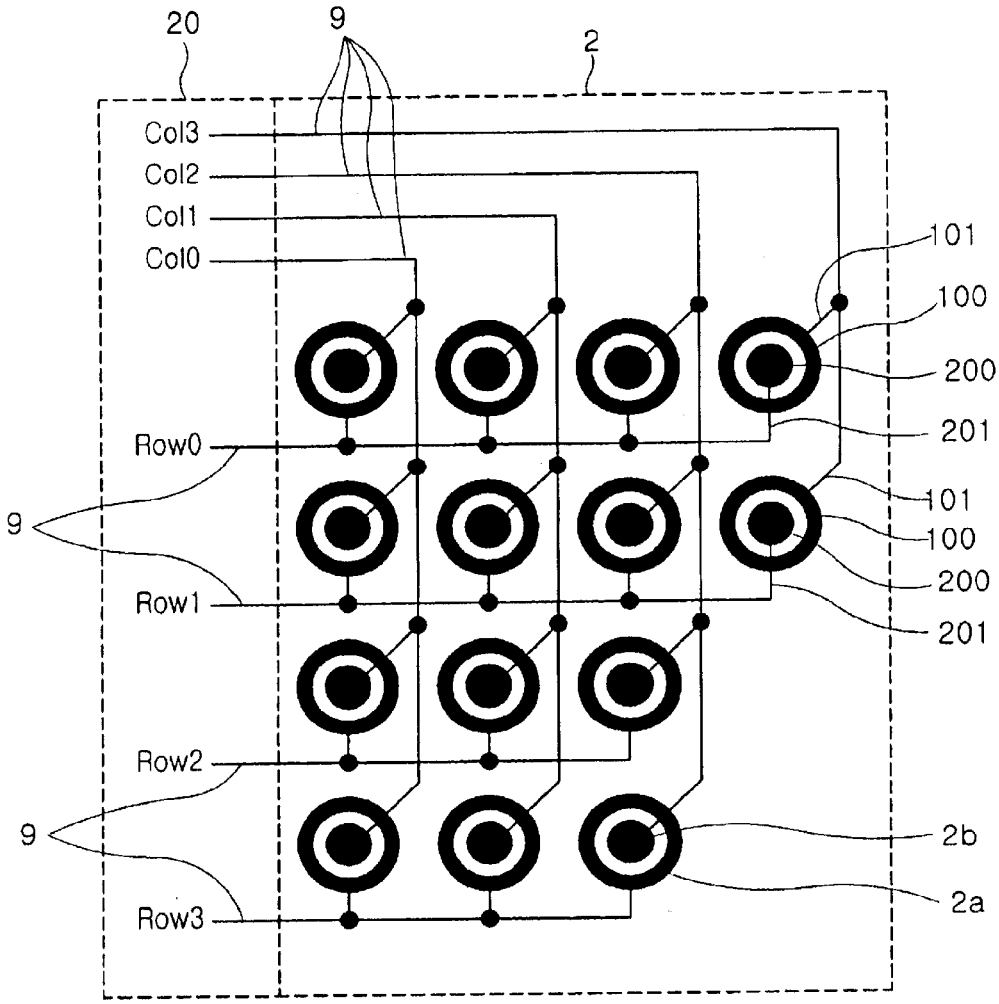
FIG. 8 is a pattern connection diagram of contact parts of domed metal keys of a key pattern connecting device for a domed metal switch according to another embodiment of the present invention.
Figure 9:
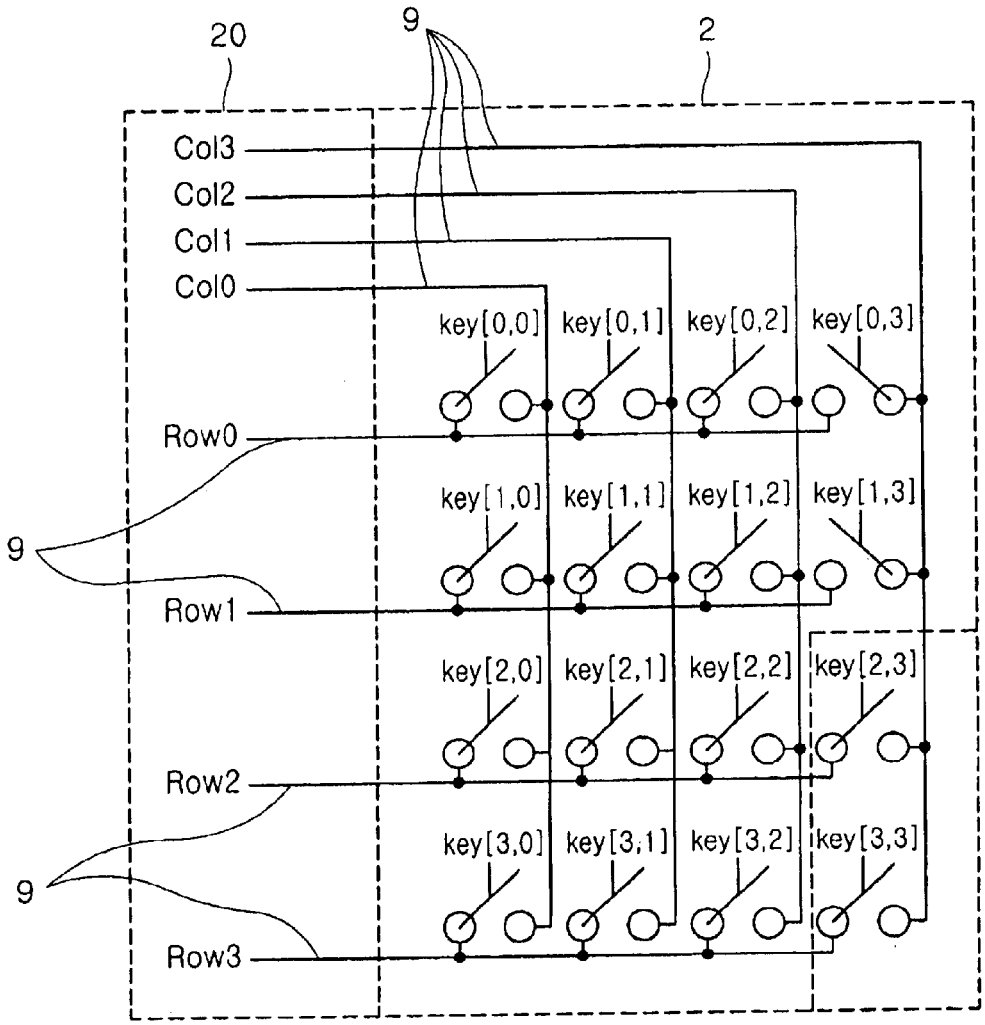
FIG. 9 is a circuit diagram of domed metal keys of a key pattern connecting device for a domed metal switch according to another embodiment of the present invention.

As illustrated in FIGS. 8 and 9, the first contact parts 2*a* (12 in number) are electrically connected to Row0, Row1, Row2, and Row3 provided to the key input controller 20 by means of the several main connection patterns 9, respectively. Similarly, the second contact parts 2*b* disposed in the first contact parts 2*a* are electrically connected to Col0, Col1, Col2, and Col3 provided to the key input controller 20 by means of the several main connection patterns 9, respectively.

The first two contact parts 100 are electrically connected to Col3, not Row0 and Row1, by means of the first main connection patterns 101, while the second contact parts 200 disposed within the first contact parts 100 are electrically connected to Row0 and Row1, not Col3, by means of the second main connection patterns 201.

The first and second contact parts 100 and 200 are arranged at one side of the key matrix in such a manner that the contact parts are in contact with the first and second connection patterns 401*a* and 401*b* of the flexible circuit 400. Under this condition, the domed metal keys 3 are provided on the surfaces of the first and second contact parts 2*a* and 2*b*; 100 and 200, respectively, in such a manner that the keys are in contact with the first contact parts 2*a* and 100 prior to pressing of the keys.

As illustrated in FIG. 11, on the surface of the main board 2 is applied the first adhesive 500, by which the flexible circuit 400 can be attached to the main board 2 in such a manner that the domed metal keys 3 and 300 project through the flexible circuit 400. On the surface of the flexible circuit 400 is applied the second adhesive 600, by which the transparent film 700 can be attached to the flexible circuit 400.

On the flexible circuit 400 are provided the first connection patterns 401*a*, by which the first contact parts 100 connected to Col3 are connected to the domed metal keys 300. Similarly, on the flexible circuit 400 are further provided the second connection patterns 401*b*, by which the first contact parts 2*a* connected to Row2 and Row3 are connected to the domed metal keys 3.

Figure 10:
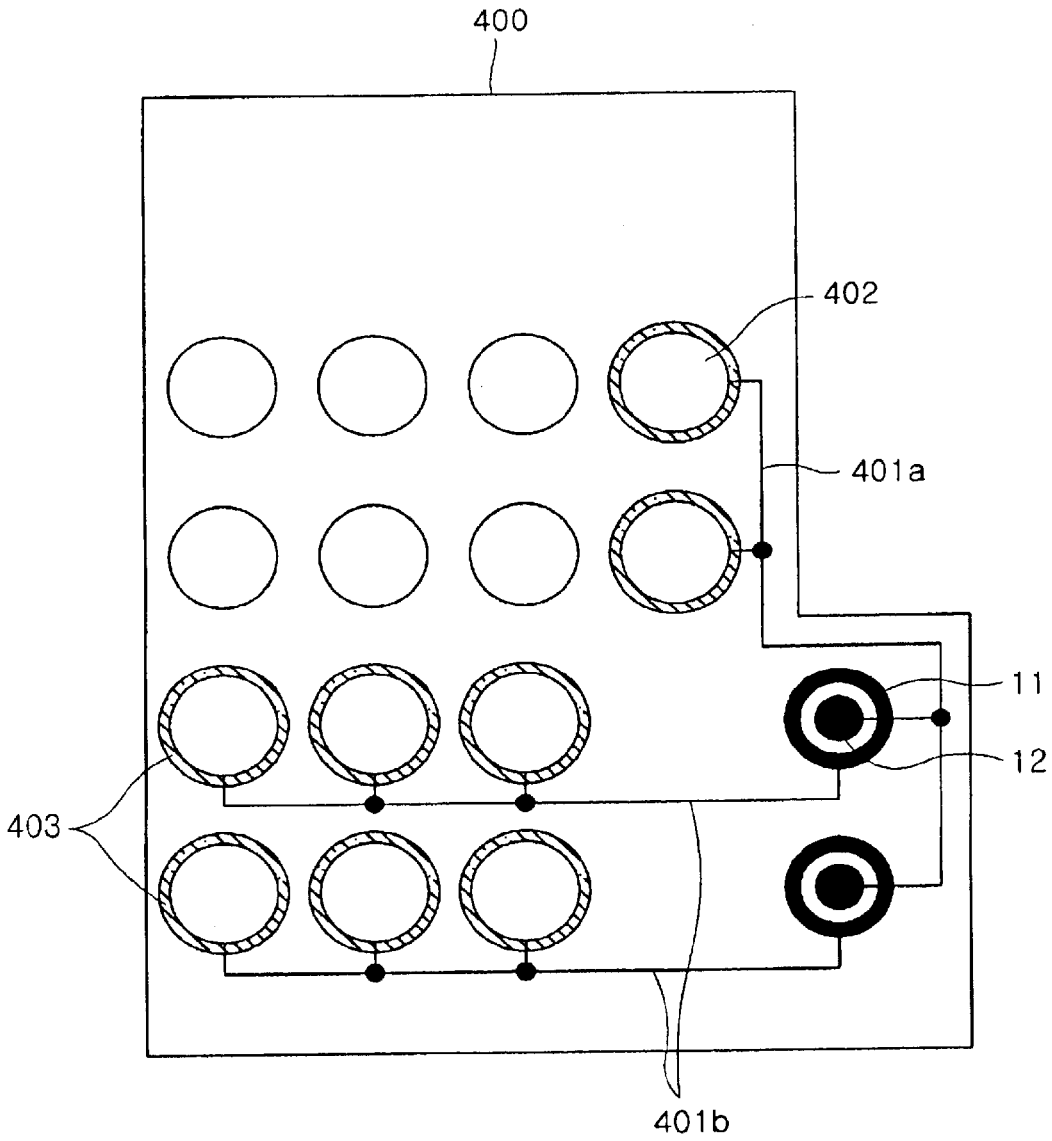
FIG. 10 is a pattern connection diagram of contact parts of a flexible circuit of a key pattern connecting device for a domed metal switch according to another embodiment of the present invention.

The flexible circuit 400 is provided with the first and second contact parts 11 and 12, which are connected to the connection patterns 401*a* and 401*b*, respectively, as illustrated in FIG. 10. The first contact parts 11 are electrically connected to the first connection patterns 401*b*, which are in contact with the domed metal keys 300, while the second contact parts 12 are electrically connected to the second connection patterns 401*a*, which are in contact with the domed metal keys 3. The flexible circuit 400 is provided at the surfaces of the first and second contact parts 11 and 12 with the auxiliary keys 3*b*.

The through holes 402 have annular contact rings 403 formed along the circumferences thereof. The annular contact rings 403 each have a diameter smaller than that of each of the domed metal keys 3 and 300 so that the annular contact rings 403 cover the edges of the domed metal keys 3 and 300.

Figure 12:
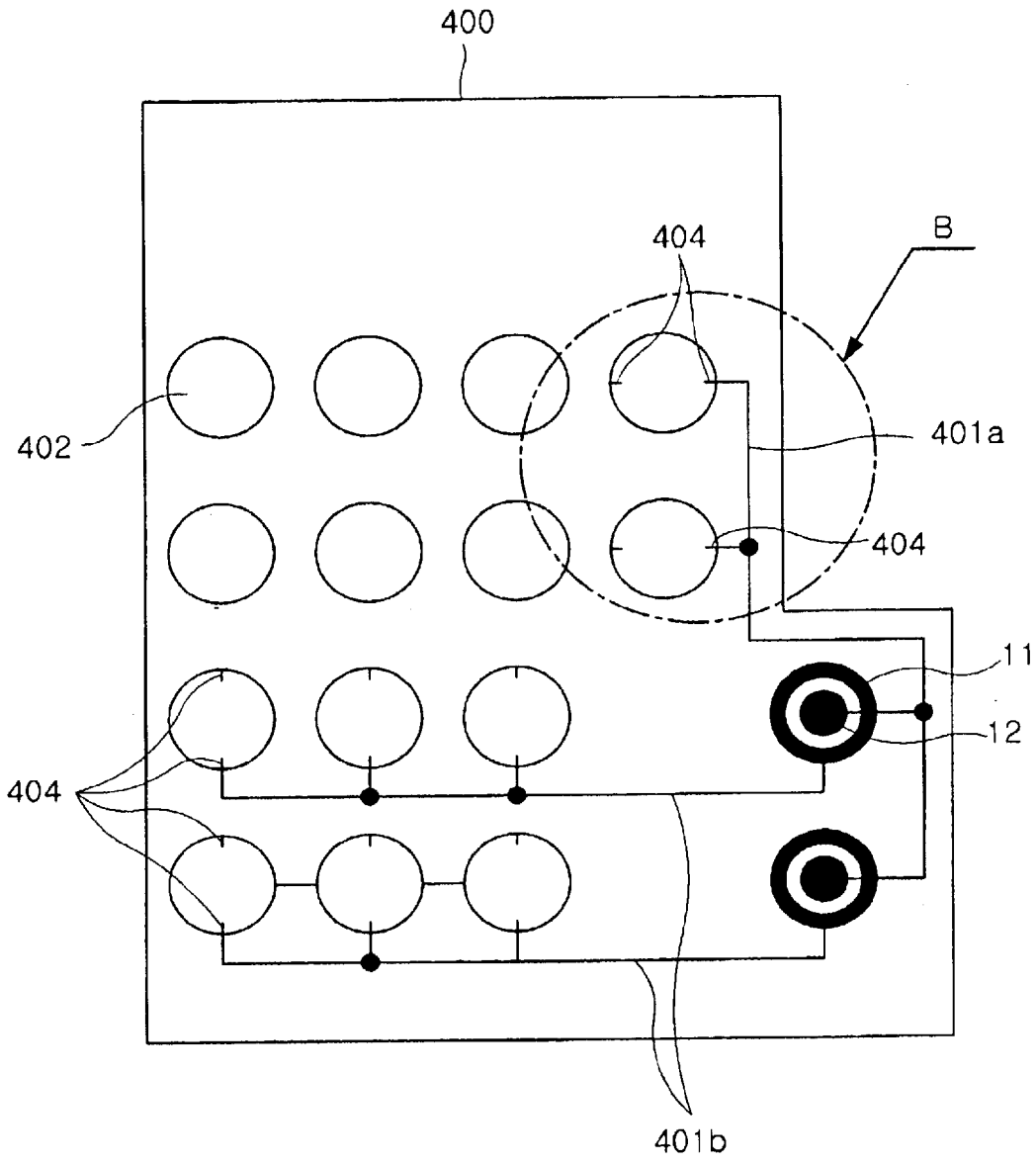
FIG. 12 is a connection diagram of contact terminals of a flexible circuit in a key pattern connecting device for a domed metal switch according to another embodiment of the present invention.
Figure 13:
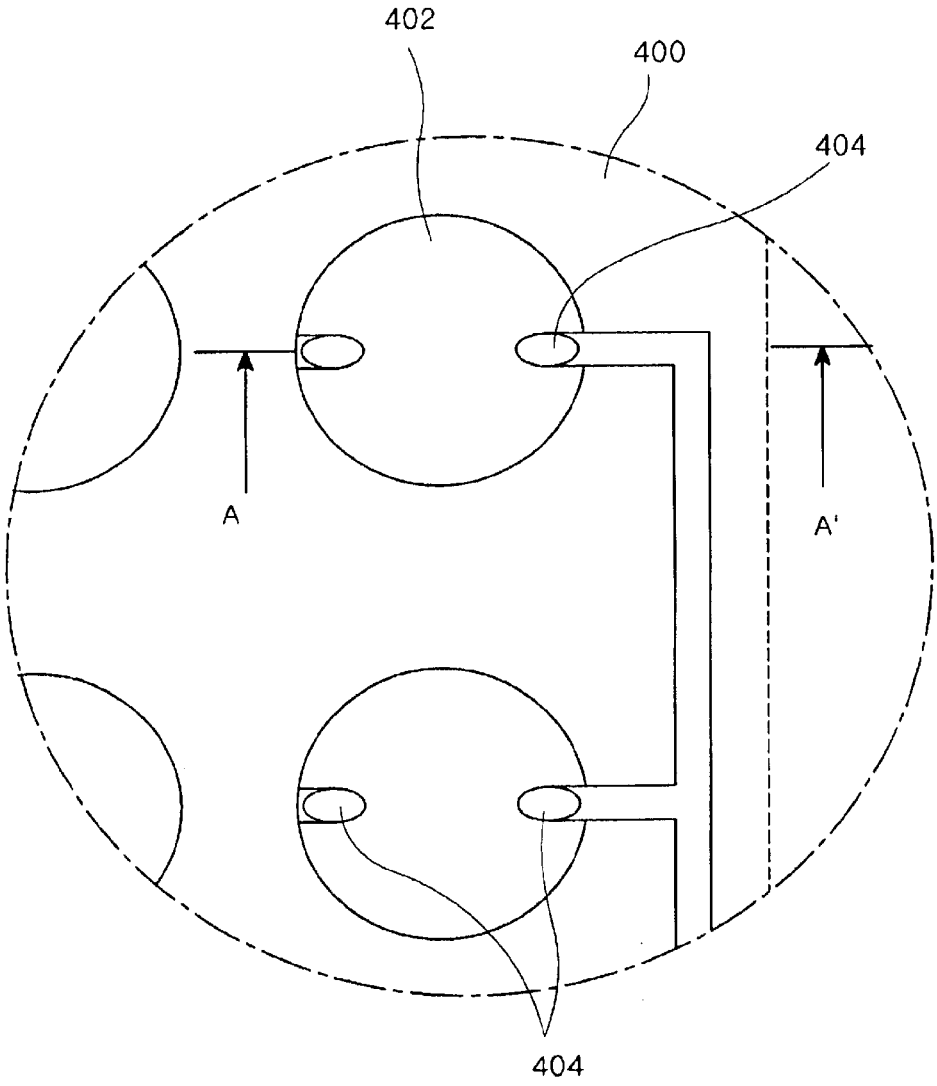
FIG. 13 is an enlarged view of "B" part of FIG. 12.
Figure 14:
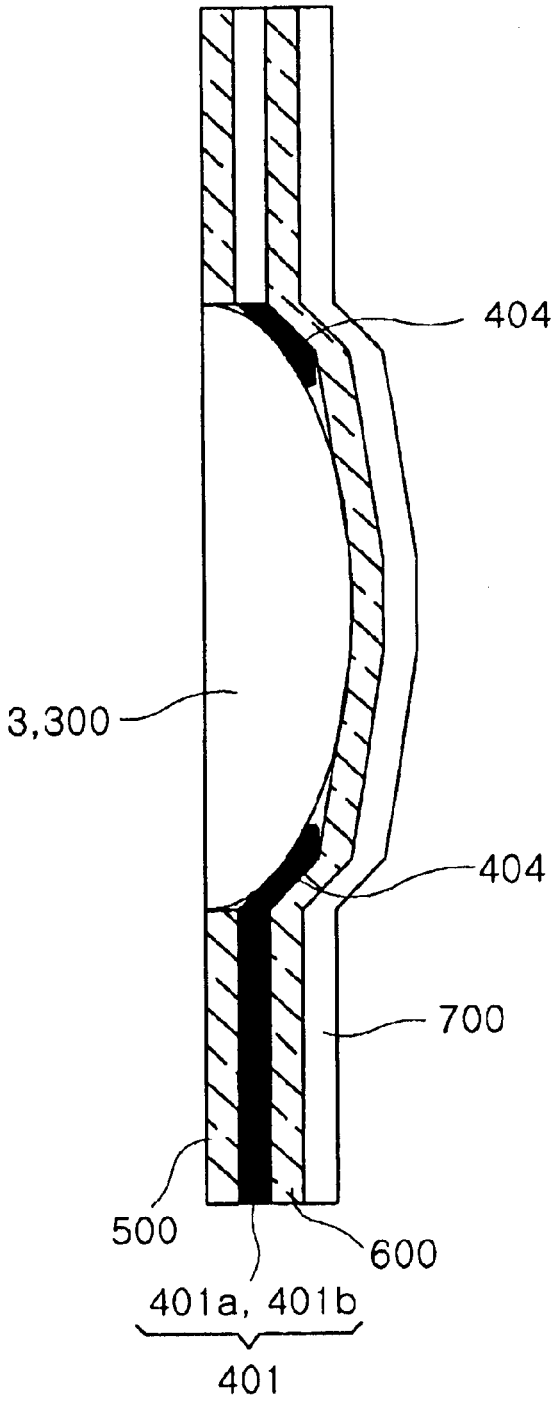
FIG. 14 is a cross sectional view taken along line A-A' of FIG. 13.

As illustrated in FIGS. 12 to 14, at least one contact terminal 404 is provided in the through holes 402 of the flexible circuit 400 inwardly from a predetermined point around the through holes 402 in such a manner that the contact terminal 404 is in contact with the domed metal keys 3 and 300 at the circumferences thereof. By virtue of the contact terminal 404, the domed metal keys 3 and 300 come into positive contact with the through holes 402, respectively.

As apparent from the above description, the connection patterns 401*a* and 401*b* are provided to the main board 2 and the flexible circuit 400, respectively, in such a manner that the main board 2 and the flexible circuit 400 are electrically connected to each other without any auxiliary key connecting part, whereby performance of the domed metal switch is improved.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A key pattern connecting device for a domed metal switch, said domed metal switch including a plurality of first and second contact parts arranged in a key matrix on a main board, said first contact parts being electrically connected to rows provided on a key input controller by means of a plurality of main connection patterns, respectively, said second contact parts, which are disposed within said first contact parts, respectively, being electrically connected to columns provided on said key input controller by means of another plurality of main connection patterns; said key pattern connecting device comprising:

at least one of said first contact parts electrically connected to one of said columns, not rows, by means of said main connection patterns on said main board;

at least one of said second contact parts electrically connected to one of said rows, not columns, by means of said main connection patterns on said main board;

a plurality of domed metal keys provided on the surfaces of said contact parts; and a flexible circuit attached to said main board in such a manner that said domed metal keys project through said flexible circuit, said flexible circuit having a plurality of connection patterns formed thereon in such a manner that the connection patterns are in contact with said domed metal keys connected to said columns and said domed metal keys connected to said rows, respectively.

2. The device as set forth in claim 1, wherein said at least one contact part electrically connected to said one of said columns and said at least one second contact part electrically connected to said one of said rows are arranged at one side of the key matrix.

3. The device as set forth in claim 1, wherein said main connection patterns include a first main connection pattern, which is electrically connected to said at least one first contact part connected to said one of said columns, and a second main connection pattern, which is electrically connected to said at least one second contact part connected to said one of said rows.

4. The device as set forth in claim 1, wherein said domed metal keys include domed metal keys connected to said columns, and domed metal keys connected to said rows.

5. The device as set forth in claim 1, wherein said flexible circuit has a plurality of through holes formed therein, through which the domed metal keys project.

6. The device as set forth in claim 5, wherein at least one of said plurality of through holes has an annular contact ring formed along a circumference, said annular contact rings each having a diameter smaller than that of each of the domed metal keys so that the annular contact rings cover the edges of the domed metal keys.

7. The device as set forth in claim 5, wherein at least one of said plurality of through holes has at least one contact terminal of a predetermined length and projected into said at least one through hole at the predetermined position on the circumference of said at least one through hole in such a manner that said contact terminal is in at least one contact with one of said domed metal keys at the circumference thereof.

8. The device as set forth in claim 1, wherein said plurality of connection patterns of said flexible circuit include first connection patterns, which come into contact with said domed metal keys connected to said columns, and second connection patterns, which come into contact with said domed metal keys connected to said rows.

9. The device as set forth in claim 1, wherein said connection patterns of said flexible circuit are connected to the circumferences of said domed metal keys at an upper part of said domed metal keys.

10. The device as set forth in claim 1, wherein said flexible circuit is provided at a bottom part thereof with a first adhesive, by which said flexible circuit is attached to said main board, and wherein said flexible circuit is further provided at a top part thereof with a second adhesive, by which a transparent film is attached to the flexible circuit.

* * * * *